US005675841A

United States Patent [19]

Jackson

[11] Patent Number: 5,675,841

[45] Date of Patent: Oct. 14, 1997

[54] HEADWEAR TETHER

[76] Inventor: Jonathan Jackson, 9400 Windy Hill Dr., Nokesville, Va. 22123

[21] Appl. No.: 427,759

[22] Filed: Apr. 24, 1995

[51] Int. Cl.[6] ..... A42B 7/00

[52] U.S. Cl. ..... 2/175.7; 2/181.4; 2/182.2; 2/182.6; 2/209.13; 2/323; 24/302

[58] Field of Search ..... 2/175.6, 175.7, 2/6.2, 181, 181.2, 181.4, 182.1, 182.2, 182.6, 209.13, 421, 422, 300, 303, 306, 311, 312, 323, 335, 336; 24/72.1, 301, 302, 510

[56] References Cited

U.S. PATENT DOCUMENTS 867,814 10/1907 Fornander ..... 2/175.7
1,782,057 11/1930 Bollinger ..... 2/323

*Primary Examiner*—Diana Biefeld

[57] ABSTRACT

A tether for coupling an article of headwear to clothing of an individual. The inventive device includes a headwear engaging assembly for coupling to an article of headwear. A tether extends from the headwear engaging assembly and terminates in a clothing engaging assembly for coupling to an article of clothing to secure the headwear relative thereto.

9 Claims, 3 Drawing Sheets

HEADWEAR TETHER

BACKGROUND OF THE INVENTION

1. Field of the Invention

The present invention relates to securing devices and more particularly pertains to an headwear tether for coupling an article of headwear to clothing of an individual.

2. Description of the Prior Art

The use of securing devices is known in the prior art. More specifically, securing devices heretofore devised and utilized are known to consist basically of familiar, expected and obvious structural configurations, notwithstanding the myriad of designs encompassed by the crowded prior art which have been developed for the fulfillment of countless objectives and requirements.

While the prior art securing devices fulfill their respective, particular objectives and requirements, the prior art does not disclose a headwear tether for coupling an article of headwear to clothing of an individual which includes a headwear engaging assembly for coupling to an article of headwear, and a tether extending from the headwear engaging assembly and terminating in a clothing engaging assembly for coupling to an article of clothing to secure the headwear relative thereto.

In these respects, the headwear tether according to the present invention substantially departs from the conventional concepts and designs of the prior art, and in so doing provides an apparatus primarily developed for the purpose of coupling an article of headwear to clothing of an individual.

SUMMARY OF THE INVENTION

In view of the foregoing disadvantages inherent in the known types of securing devices now present in the prior art, the present invention provides a new headwear tether construction wherein the same can be utilized for coupling an article of headwear to clothing of an individual. As such, the general purpose of the present invention, which will be described subsequently in greater detail, is to provide a new headwear tether apparatus and method which has many of the advantages of the securing devices mentioned heretofore and many novel features that result in a headwear tether which is not anticipated, rendered obvious, suggested, or even implied by any of the prior art securing devices, either alone or in any combination thereof.

To attain this, the present invention generally comprises a tether for coupling an article of headwear to clothing of an individual. The inventive device includes a headwear engaging assembly for coupling to an article of headwear. A tether extends from the headwear engaging assembly and terminates in a clothing engaging assembly for coupling to an article of clothing to secure the headwear relative thereto.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new headwear tether apparatus and method which has many of the advantages of the securing devices mentioned heretofore and many novel features that result in a headwear tether which is not anticipated, rendered obvious, suggested, or even implied by any of the prior art securing devices, either alone or in any combination thereof.

It is another object of the present invention to provide a new headwear tether which may be easily and efficiently manufactured and marketed.

It is a further object of the present invention to provide a new headwear tether which is of a durable and reliable construction.

An even further object of the present invention is to provide a new headwear tether which is susceptible of a low cost of manufacture with regard to both materials and labor, and which accordingly is then susceptible of low prices of sale to the consuming public, thereby making such headwear tethers economically available to the buying public.

Still yet another object of the present invention is to provide a new headwear tether which provides in the apparatuses and methods of the prior art some of the advantages thereof, while simultaneously overcoming some of the disadvantages normally associated therewith.

Still another object of the present invention is to provide a new headwear tether for coupling an article of headwear to clothing of an individual.

Yet another object of the present invention is to provide a new headwear tether which includes a headwear engaging assembly for coupling to an article of headwear and a tether extending from the headwear engaging assembly and terminating in a clothing engaging assembly for coupling to an article of clothing to secure the headwear relative thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
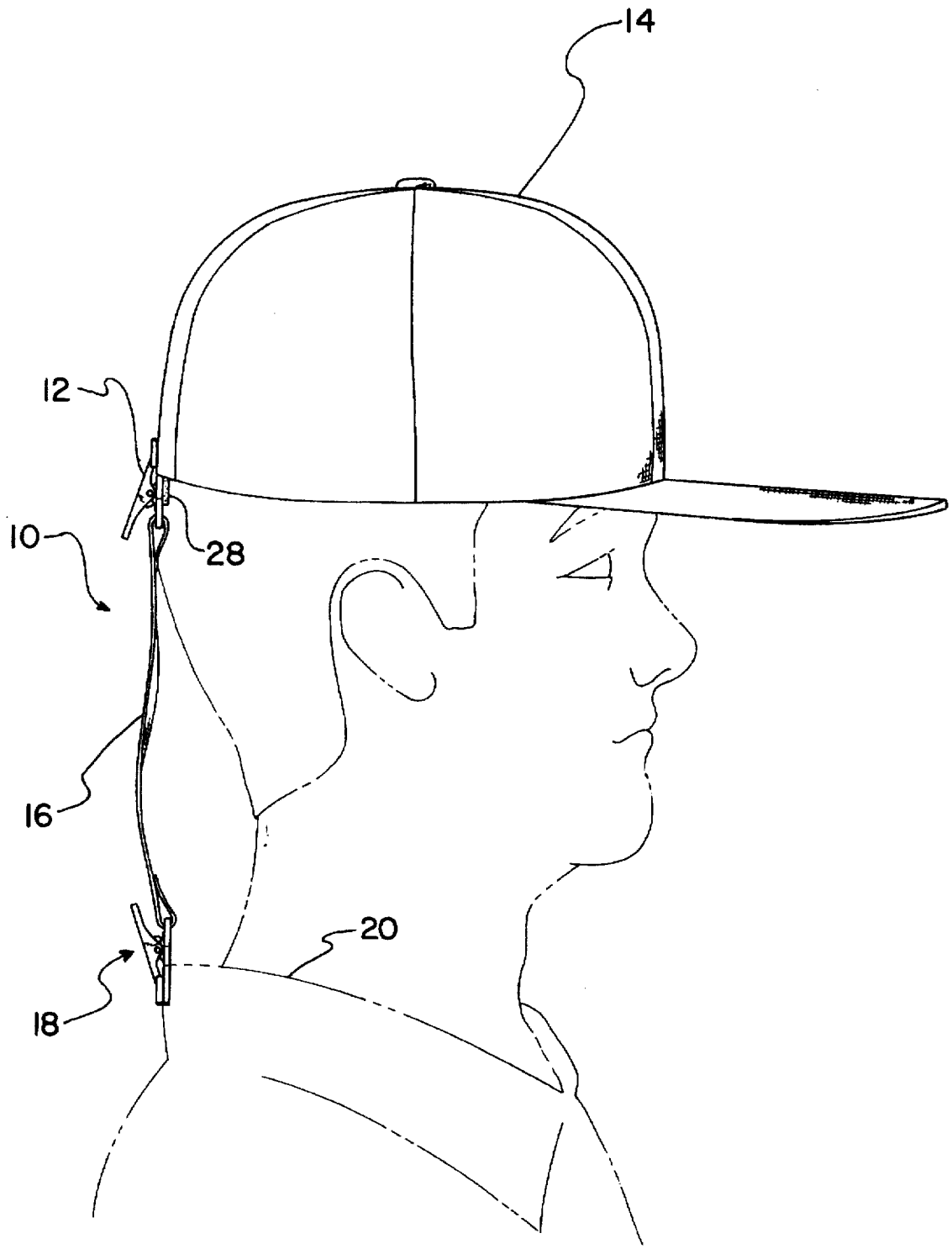
FIG. 1 is an isometric illustration of a headwear tether according to the present invention in use.

With reference now to the drawings, and in particular to FIGS. 1–5 thereof, a new headwear tether embodying the principles and concepts of the present invention and generally designated by the reference numeral 10 will be described.

More specifically, it will be noted that the headwear tether 10 comprises a headwear engaging means 12 for securing to an article of headwear such as the cap 14 illustrated in FIG. 1 of the drawings. A tether 16 extends from the headwear engaging means 12 and terminates in a free distal end whereat a clothing engaging means 18 is secured for coupling the tether 16 to an article of clothing 20 of an individual wearing the cap 14. By this structure, the cap 14 is secured relative to the article of clothing 20 so as to preclude a loss of the cap should it be separated from an individual's head.

Figure 2:
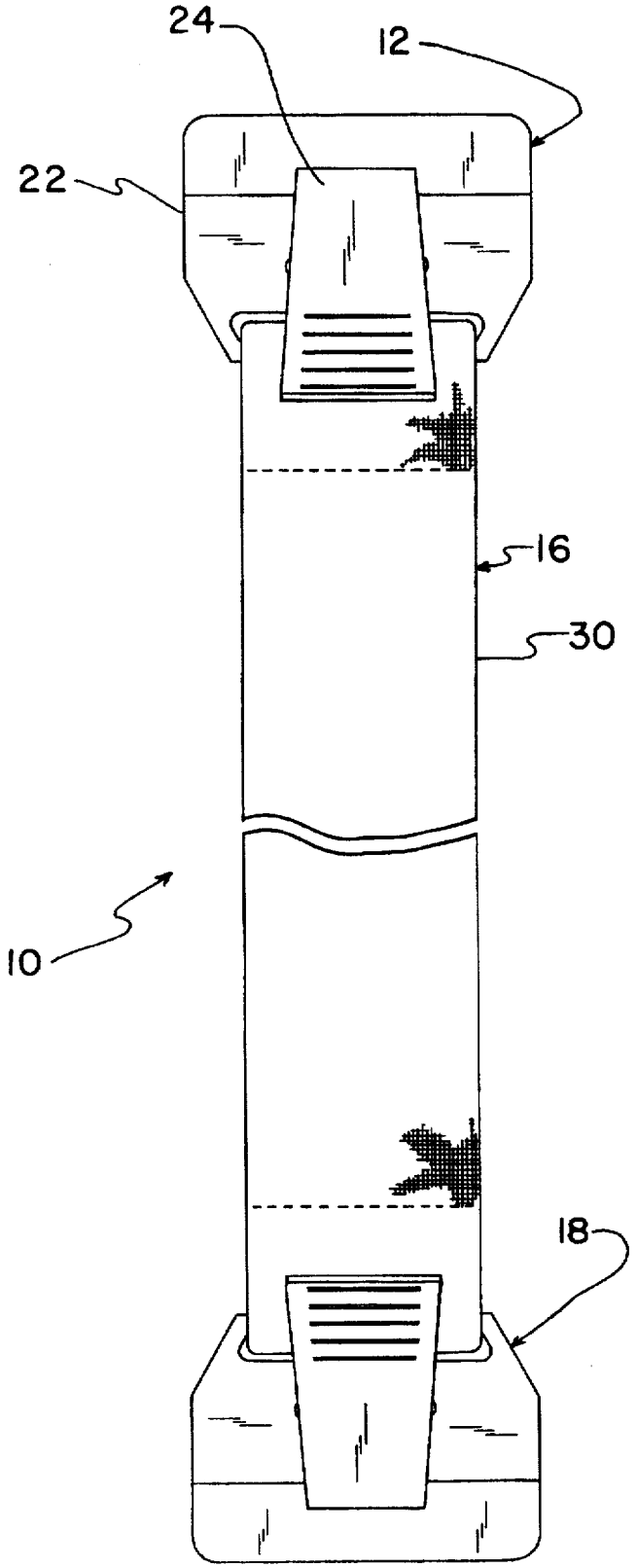
FIG. 2 is a rear elevation view thereof.
Figure 3:
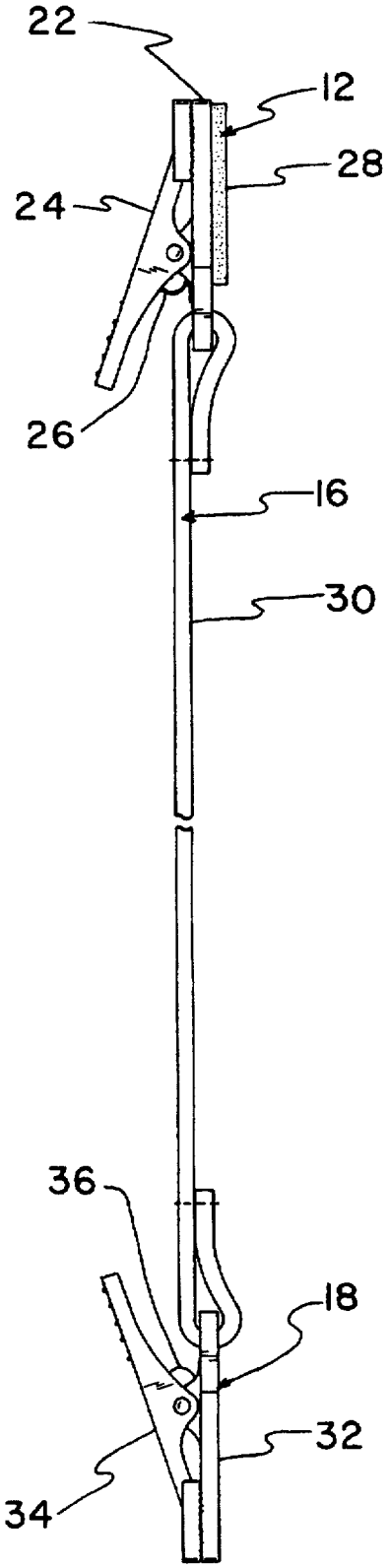
FIG. 3 is a side elevation view of the invention, per se.

As best illustrated in FIGS. 2 and 3, it can be shown that the headwear engaging means 12 according to the present invention 10 preferably comprises a base plate 22 having a clamp arm 24 pivotally mounted relative thereto. A spring 26 interposed between the clamp arm 24 and the base plate 22 biases the clamp arm towards the base plate such that a portion of the cap 14 can be captured between the clamp arm and the base plate as shown in FIG. 1. An elastomeric pad 28 is secured to an interior surface of the base plate 22 and configured for positioning adjacent to an individual's head so as to comfortably separate the base plate 22 therefrom.

With continuing reference to FIGS. 2 and 3, it can be shown that the tether 16 preferably comprises an elongated strap 30 coupled to the base plate 22 of the headwear engaging means 12. The strap 30 extends from the base plate 22 and terminates in a free distal end whereat the clothing engaging means 18 is mounted. The strap 30 can be of any desired length, but is preferably of a length sufficient to extend from the cap 14 to a collar of the article of clothing 20 worn by the individual utilizing the device 10 as shown in FIG. 1.

The clothing engaging means 18, as shown in FIGS. 2 and 3 may similarly comprise a base plate 32 having a clamp arm 34 pivotally mounted thereto. A spring 36 interposed between the clamp arm 34 and the base plate 32 biases a portion of the clamp arm into engagement with a portion of the base plate 32, whereby a portion of the article of clothing 20 can be captured therebetween as shown in FIG. 1 of the drawings. By this structure, the clothing engaging means 18 can be easily coupled to a collar or other portion of an article of clothing 20 to secure the device 10 and the associated cap 14 relative thereto.

Figure 4:
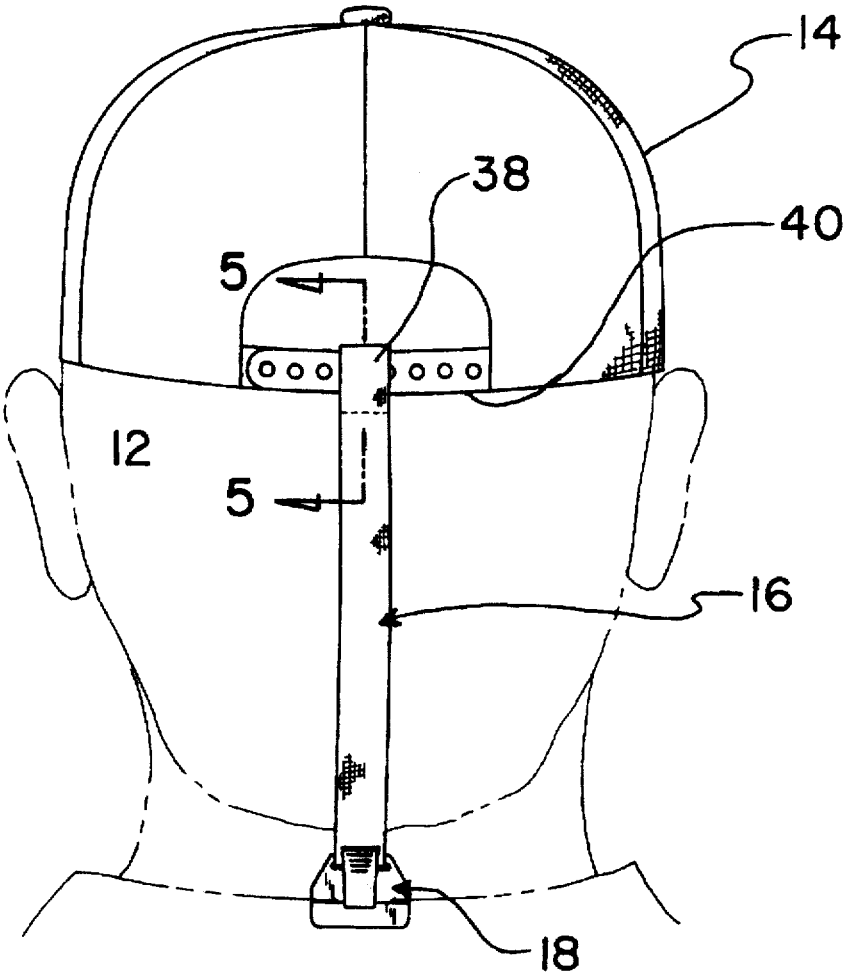
FIG. 4 is a rear elevation view of an alternative form of the present invention in use.
Figure 5:
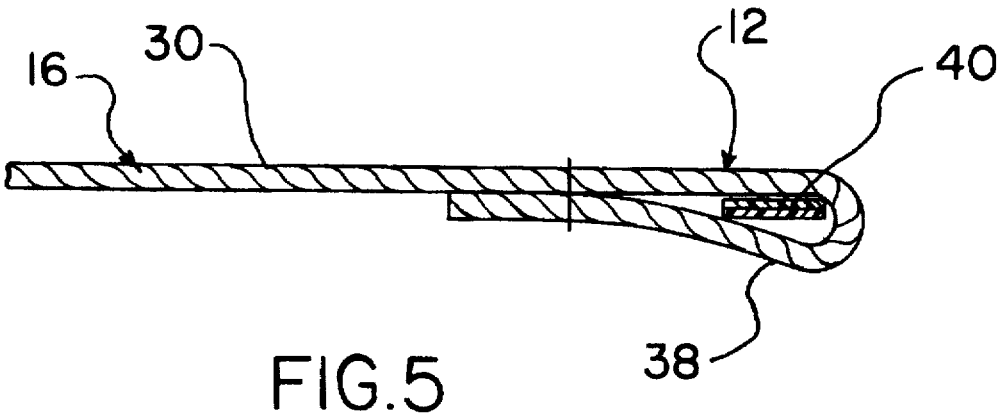
FIG. 5 is a cross sectional view taken along line 5—5 of FIG. 4.

Referring now to FIGS. 4 and 5, it can be shown that the headwear engaging means 12 of the present invention 10 may alternatively comprise a loop 38 formed in the strap 30 of the tether 16 at the free distal end thereof. To this end, the strap 30 is simply folded upon itself and stitched thereto so as to define the loop 38 as shown in FIG. 5 of the drawings. A portion of the cap 14, such as an adjustment band 40 thereof can be positioned through the loop 38 so as to couple the tether 16 relative to the cap 14. To this end, the loop 38 can be permanently configured as shown in FIG. 5 wherein stitching secures the strap 30 onto itself to define the loop 38. Alternatively, a fabric fastening material such as is commonly known under the trademark "VELCRO" can be interposed between portions of the strap 30 so as to form the loop 38 in an openable manner, whereby the loop 38 can be positioned about the adjustment band 40 as desired. However, in the configuration illustrated in FIGS. 4 and 5 of the drawings, the adjustment band 40 can simply be uncoupled and positioned through the loop 38, whereby a re-coupling of the adjustment band 40 to itself will secure the headwear engaging means 12 about the adjustment band as illustrated in FIG. 4.

In use, the headwear tether 10 according to the present invention can be easily utilized to secure an article of headwear such as a cap 14 relative to clothing 20 or other objects associated with an individual. The present invention 10 serves to limit remote movement of the cap 14 relative to an individual should the cap 14 become separated from the individual's head such as occurs during movement of the individual as a result of wind passing thereby.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A headwear tether comprising:

a headwear engaging means for securing to an article of headwear; the headwear engaging means comprising a base plate having a clamp arm pivotally mounted relative thereto; a spring interposed between the clamp arm and the base plate so as to bias the clamp arm towards the base plate such that a portion of an article of headwear can be captured between the clamp arm and the base plate; an elastomeric pad secured to an interior surface of the base plate and adapted for positioning adjacent to an individual's head so as to comfortably separate the base plate therefrom a tether extending from the headwear engaging means and terminating in a free distal end;

a clothing engaging means secured to the free distal end of the tether for coupling to an article of clothing.

2. The headwear tether of claim 1, wherein the tether comprises an elongated strap coupled to the base plate of the headwear engaging means, the strap extending from the base plate and terminating in the free distal end whereat the clothing engaging means is mounted.

3. The headwear tether of claim 2, wherein the clothing engaging means comprises a base plate having a clamp arm pivotally mounted thereto; a spring interposed between the clamp arm and the base plate so as to bias the clamp arm towards the base plate such that a portion of an article of clothing can be captured between the clamp arm and the base plate.

4. A tethered headwear comprising:

an article of headwear;

a headwear engaging means which is secured to the article of headwear; the headwear engaging means comprising a base plate having a clamp arm pivotally mounted relative thereto; a spring interposed between the clamp arm and the base plate so as to bias the clamp am towards the base plate, with a portion of the article of headwear captured between the clamp arm and the base plate; an elastomeric pad secured to an interior surface of the base plate and adapted for positioning adjacent to an individual's head so as to comfortably separate the base plate therefrom;

a tether extending from the headwear engaging means and terminating in a free distal end;

a clothing engaging means secured to the free distal end of the tether for coupling to an article of clothing.

5. The tethered headwear of claim 4, wherein the tether comprises an elongated strap coupled to the base plate of the headwear engaging means, the strap extending from the base plate and terminating in the free distal end whereat the clothing engaging means is mounted.

6. The tethered headwear of claim 5, wherein the clothing engaging means comprises a base plate having a clamp arm pivotally mounted thereto; a spring interposed between the clamp arm and the base plate so as to bias the clamp arm towards the base plate such that a portion of an article of clothing can be captured between the clamp arm and the base plate.

7. A tethered ensemble comprising:

an article of clothing;

an article of headwear;

a headwear engaging means which is secured to the article of headwear; the headwear engaging means comprising a base plate having a clamp arm pivotally mounted relative thereto; a spring interposed between the clamp arm and the base plate so as to bias the clamp arm towards the base plate, with a portion of the article of headwear captured between the clamp arm and the base plate; an elastomeric pad secured to an interior surface of the base plate and adapted for positioning adjacent to an individual's head so as to comfortably separate the base plate therefrom;

a tether extending from the headwear engaging means and terminating in a free distal end;

a clothing engaging means secured to the free distal end of the tether for coupling to the article of clothing.

8. The tethered ensemble of claim 7, wherein the tether comprises an elongated strap coupled to the base plate of the headwear engaging means, the strap extending from the base plate and terminating in the free distal end whereat the clothing engaging means is mounted.

9. The tethered ensemble of claim 8, wherein the clothing engaging means comprises a base plate having a clamp arm pivotally mounted thereto; a spring interposed between the clamp arm and the base plate so as to bias the clamp arm towards the base plate, with a portion of the article of clothing being captured between the clamp arm and the base plate.

* * * * *